US010654283B2

(12) United States Patent
Saeki et al.

(10) Patent No.: US 10,654,283 B2
(45) Date of Patent: May 19, 2020

(54) PRINTING APPARATUS

(71) Applicant: CANON KABUSHIKI KAISHA, Tokyo (JP)

(72) Inventors: Tsuyoshi Saeki, Kawasaki (JP); Toshiaki Tokisawa, Kawasaki (JP); Takashi Abe, Kawasaki (JP); Yumi Mukoyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/360,400

(22) Filed: Mar. 21, 2019

(65) Prior Publication Data

US 2019/0299650 A1 Oct. 3, 2019

(30) Foreign Application Priority Data

Mar. 30, 2018 (JP) ..... 2018-066377

(51) Int. Cl.
*B41J 2/175* (2006.01)
*B41J 2/18* (2006.01)
(Continued)

(52) U.S. Cl.
CPC ..... *B41J 2/18* (2013.01); *B41J 2/1752* (2013.01); *B41J 2/17566* (2013.01);
(Continued)

(58) Field of Classification Search
CPC ..... B41J 2/175; B41J 2/1752; B41J 2/17566; B41J 2/17579; B41J 2/18; B41J 29/02; B41J 29/38; B41J 2002/17579
See application file for complete search history.

(56) References Cited

U.S. PATENT DOCUMENTS 5,657,057 A 8/1997 Nakajima et al. ..... 347/7
7,594,717 B2 * 9/2009 Sheinman ..... B41J 2/175 347/89

(Continued)

FOREIGN PATENT DOCUMENTS

JP 2011-240628 12/2011

OTHER PUBLICATIONS

U.S. Appl. No. 16/288,729, filed Feb. 28, 2019.
U.S. Appl. No. 16/361,301, filed Mar. 22, 2019.

*Primary Examiner* — Anh T Vo
(74) *Attorney, Agent, or Firm* — Venable LLP

(57) ABSTRACT

A printing apparatus includes: a print head configured to eject ink; an ink tank configured to contain the ink; an ink flow path plate having a supply flow path for guiding ink to be supplied from the ink tank to the print head, and a collection flow path for guiding ink to be collected from the print head to the ink tank and provided below the ink tank in a gravitational direction; an atmosphere communication plate provided above the ink tank in the gravitational direction and having an atmosphere communication flow path for communicating the ink tank with atmosphere; a first functional component provided above the ink flow path plate in the gravitational direction to act on at least one of the supply flow path and the collection flow path; and a second functional component provided below the atmosphere communication plate in the gravitational direction to act on the atmosphere communication flow path.

18 Claims, 14 Drawing Sheets

(51) Int. Cl.
*B41J 29/38* (2006.01)
*B41J 29/02* (2006.01)

(52) U.S. Cl.
CPC ..... *B41J 2/17596* (2013.01); *B41J 29/02* (2013.01); *B41J 29/38* (2013.01); *B41J 2002/17579* (2013.01)

(56) References Cited

U.S. PATENT DOCUMENTS

| | | | | |
|---|---|---|---|---|
| 8,100,500 | B2 * | 1/2012 | Bansyo | B41J 2/16532 347/19 |
| 9,682,564 | B2 | 6/2017 | Saeki et al. | B41J 2/17513 |
| 9,751,318 | B2 | 9/2017 | Iwano et al. | B41J 2/17523 |
| 10,124,597 | B2 * | 11/2018 | Alessi | B41J 2/17596 |
| 2011/0285767 | A1 | 11/2011 | Tanaka et al. | 347/6 |
| 2017/0326882 | A1 | 11/2017 | Okude et al. | B41J 2/01 |
| 2019/0009557 | A1 | 1/2019 | Arai et al. | B41J 2/17596 |
| 2019/0009561 | A1 | 1/2019 | Mukoyama et al. | B41J 2/21 |
| 2019/0009562 | A1 | 1/2019 | Abe et al. | B41J 2/16505 |
| 2019/0009563 | A1 | 1/2019 | Tokisawa et al. | B41J 2/17596 |

* cited by examiner

PRINTING APPARATUS

BACKGROUND OF THE INVENTION

Field of the Invention

The present invention relates to a printing apparatus.

Description of the Related Art

There is an inkjet printing apparatus that supplies ink from a tank to a print head and collects the ink from the print head to the tank so as to perform print operation while circulating the ink. Japanese Patent Laid-Open No. 2011-240628 discloses an inkjet printing apparatus having an ink circulation system which is provided with a supply path for supplying ink from a storage tank to a print head, a collection path for collecting ink from the print head to the storage tank, and an atmosphere communication path communicating with the atmosphere. The supply path and the collection path are each provided with a pump for circulating the ink.

Implementation of miniaturization of an inkjet printing apparatus requires the compactness of units of the ink circulation system. In order to ensure compactness, it is preferable that the atmosphere communication path communicating with the atmosphere should be provided at a position close to an air layer of the tank, and should typically be provided above the tank in the gravitational direction. Each of the flow paths such as the supply path, the collection path, and the atmosphere communication path, is connected with functional components acting on the flow path. The functional components include, for example, a drive valve for opening and closing the flow path.

In a case where the atmosphere communication path is provided above the tank in the gravitational direction, the compactness of the units of the ink circulation system may be hindered by the existence of the functional components that act on the atmosphere communication path. For example, in a case where the functional components are disposed above the atmosphere communication path in the gravitational direction, the entire units of the ink circulation system are enlarged in the gravitational direction by the sizes of the individual functional components.

SUMMARY OF THE INVENTION

A printing apparatus according to one aspect of the present invention includes: a print head configured to eject ink; an ink tank configured to contain the ink; an ink flow path plate having a supply flow path for guiding ink to be supplied from the ink tank to the print head, and a collection flow path for guiding ink to be collected from the print head to the ink tank and provided below the ink tank in a gravitational direction; an atmosphere communication plate provided above the ink tank in the gravitational direction and having an atmosphere communication flow path for communicating the ink tank with atmosphere; a first functional component provided above the ink flow path plate in the gravitational direction to act on at least one of the supply flow path and the collection flow path; and a second functional component provided below the atmosphere communication plate in the gravitational direction to act on the atmosphere communication flow path.

Further features of the present invention will become apparent from the following description of exemplary embodiments with reference to the attached drawings.

DESCRIPTION OF THE EMBODIMENTS

Figure 1:
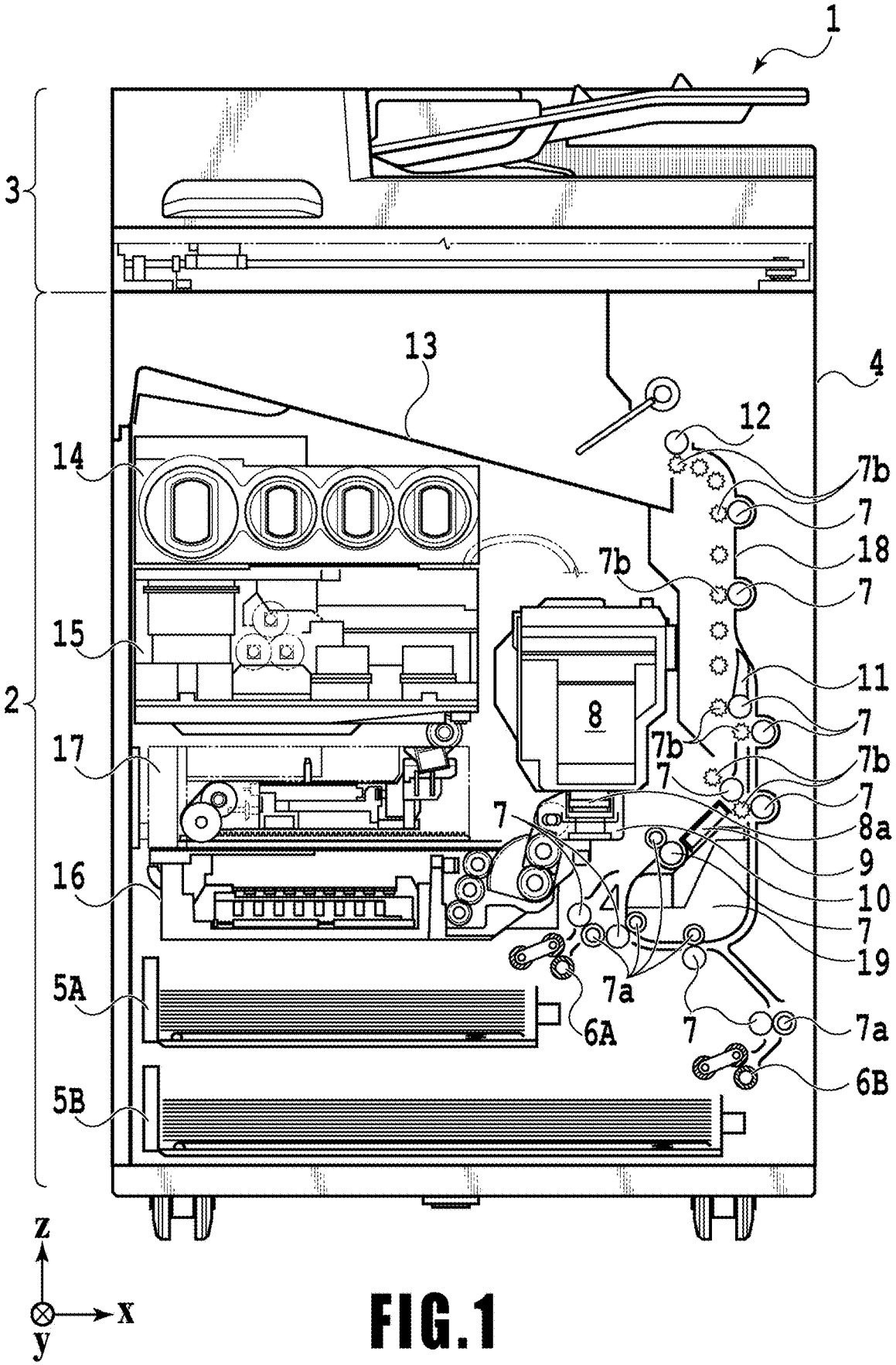
FIG. 1 is a diagram showing a printing apparatus in a standby state.

Embodiments of the present invention will be described below with reference to the drawings. It should be noted that the following embodiments do not limit the present invention and that not all of the combinations of the characteristics described in the present embodiments are essential for solving the problem to be solved by the present invention. Incidentally, the same reference numeral refers to the same component in the following descriptions. Furthermore, relative positions, shapes, and the like of the constituent elements described in the embodiments are exemplary only and are not intended to limit the scope of the invention.

First Embodiment

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction (gravitational direction).

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted.

FIG. 1 shows the printing apparatus 1 in a standby state in which neither print operation nor scan operation is performed.

In the print unit 2, a first cassette 5A and a second cassette 5B for housing a print medium (cut sheet) S are detachably provided at the bottom of a casing 4 in the vertical direction. A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for placing and housing a print medium S that was subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. In a case where the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports, from the back side, a print medium S subjected to print operation by the print head 8. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8.

Figure 2:
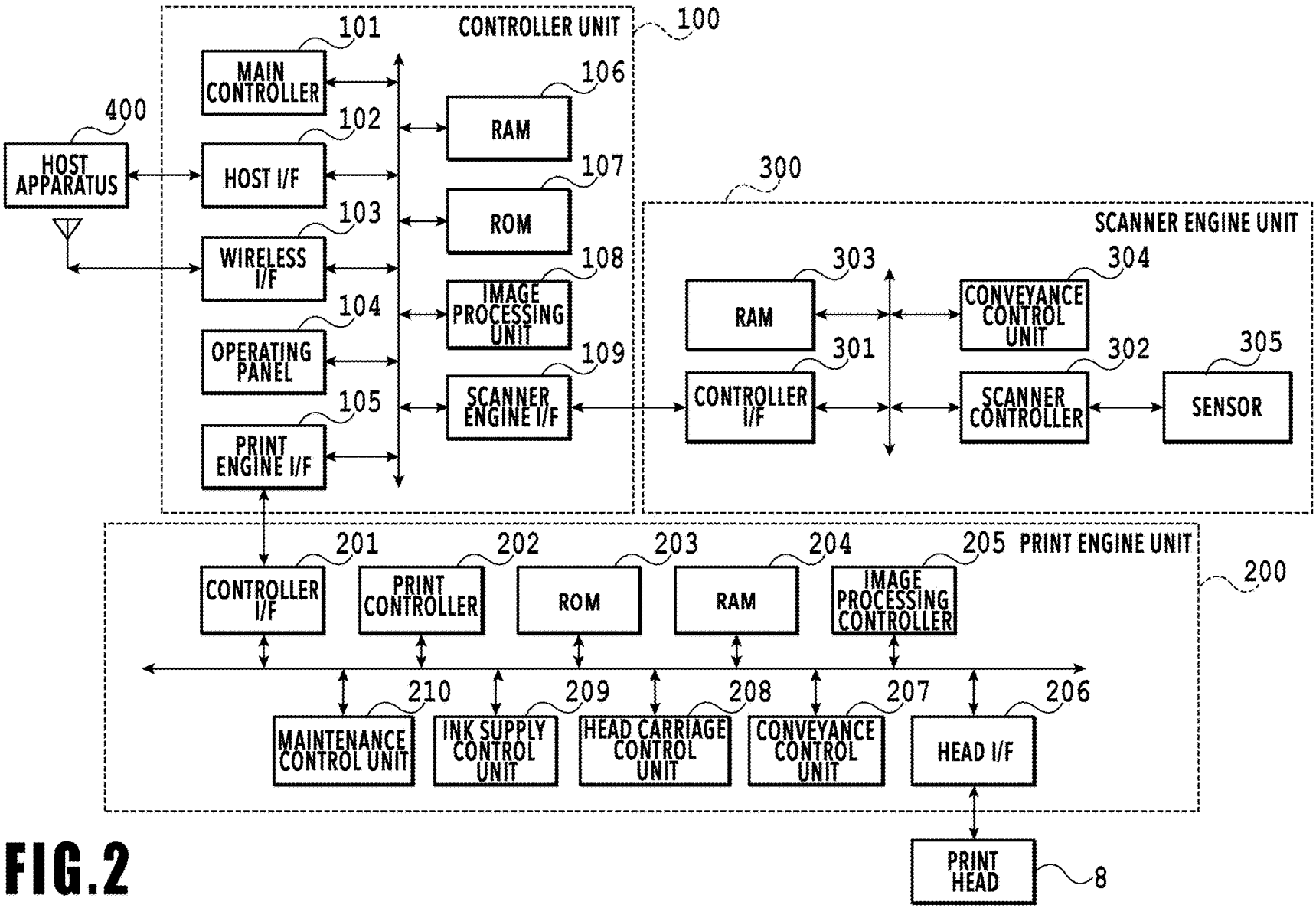
FIG. 2 is a control configuration diagram of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, in a case where a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, if a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. Once various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 at the time of performing maintenance operation for the print head 8.

In the scanner engine unit 300, the main controller 101 controls hardware resources of a scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller OF 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
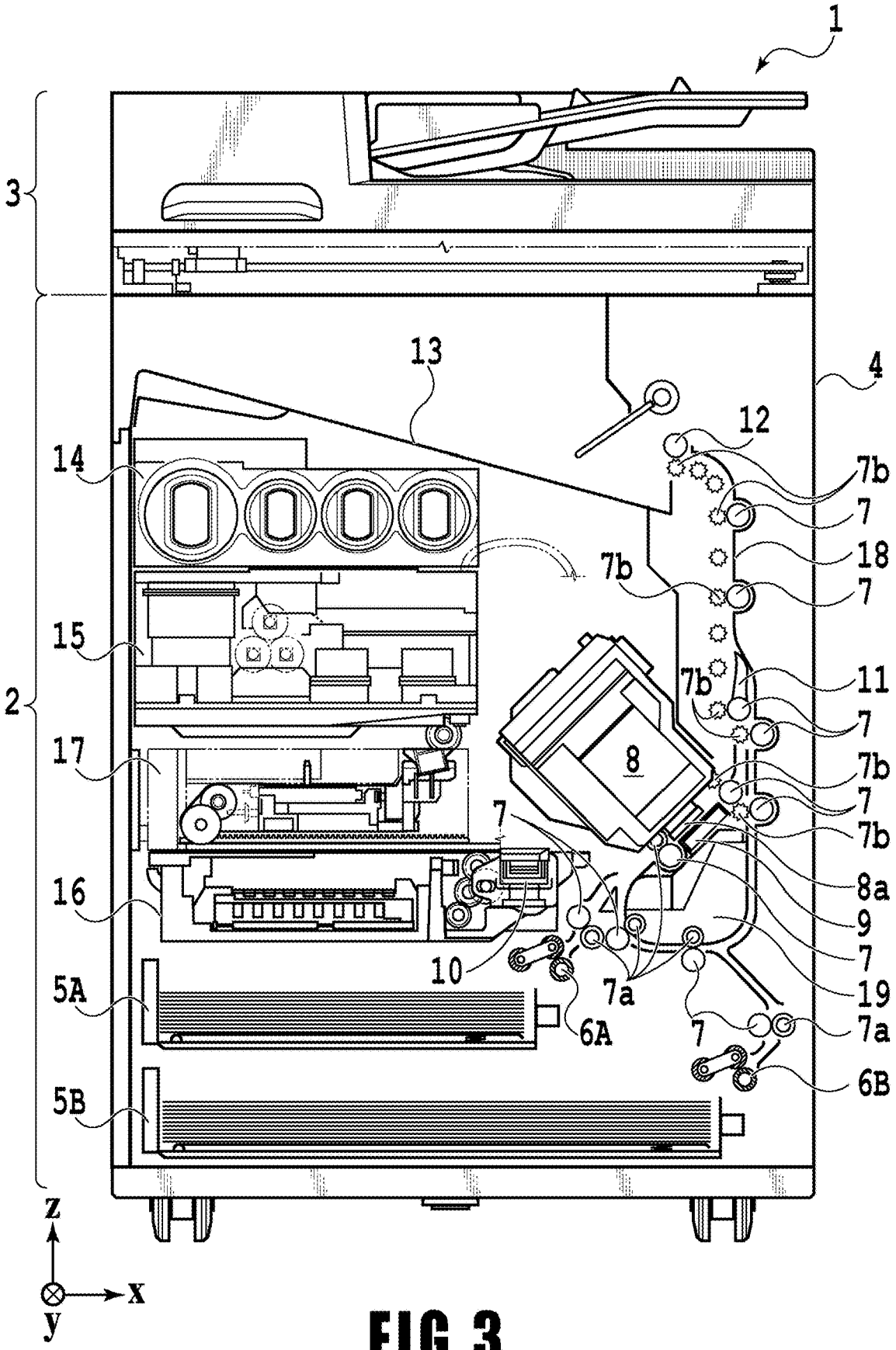
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about at 45° with respect to the horizontal plane. The ejection opening surface 8*a* of the print head 8 in a printing position is also inclined about at 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the foregoing procedure to move the print head 8 from the printing position to the standby position.

Figure 4:
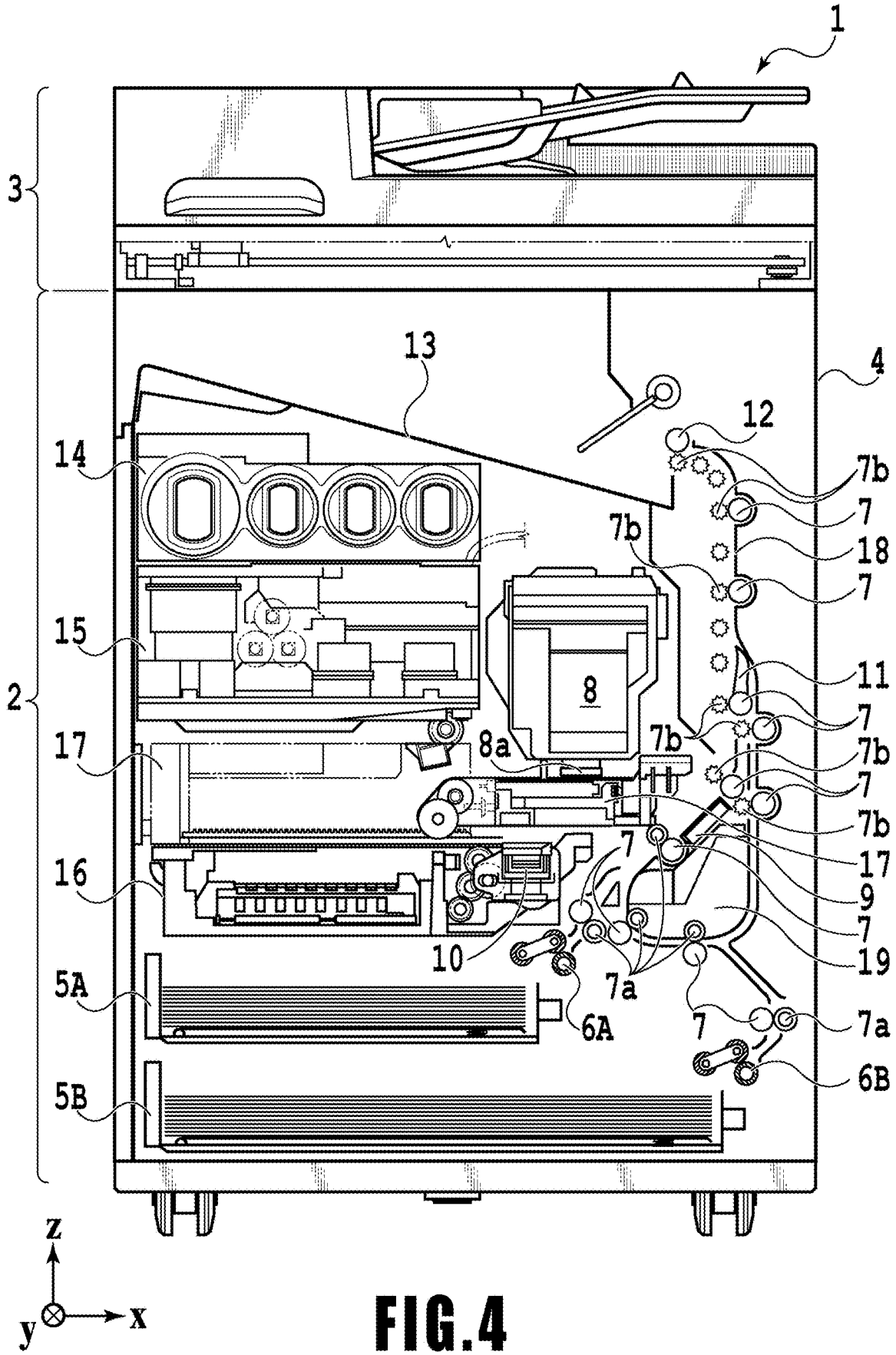
FIG. 4 is a diagram showing the printing apparatus in a maintenance state.

FIG. 4 is a diagram showing the printing apparatus 1 in a maintenance state. In the case of moving the print head 8 from the standby position shown in FIG. 1 to a maintenance position shown in FIG. 4, the print controller 202 moves the print head 8 vertically upward and moves the cap unit 10 vertically downward. The print controller 202 then moves the wiping unit 17 from the evacuation position to the right in FIG. 4. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 4, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by the maintenance unit 16.

(Ink Supply Unit (Ink Circulation System))

Figure 5:
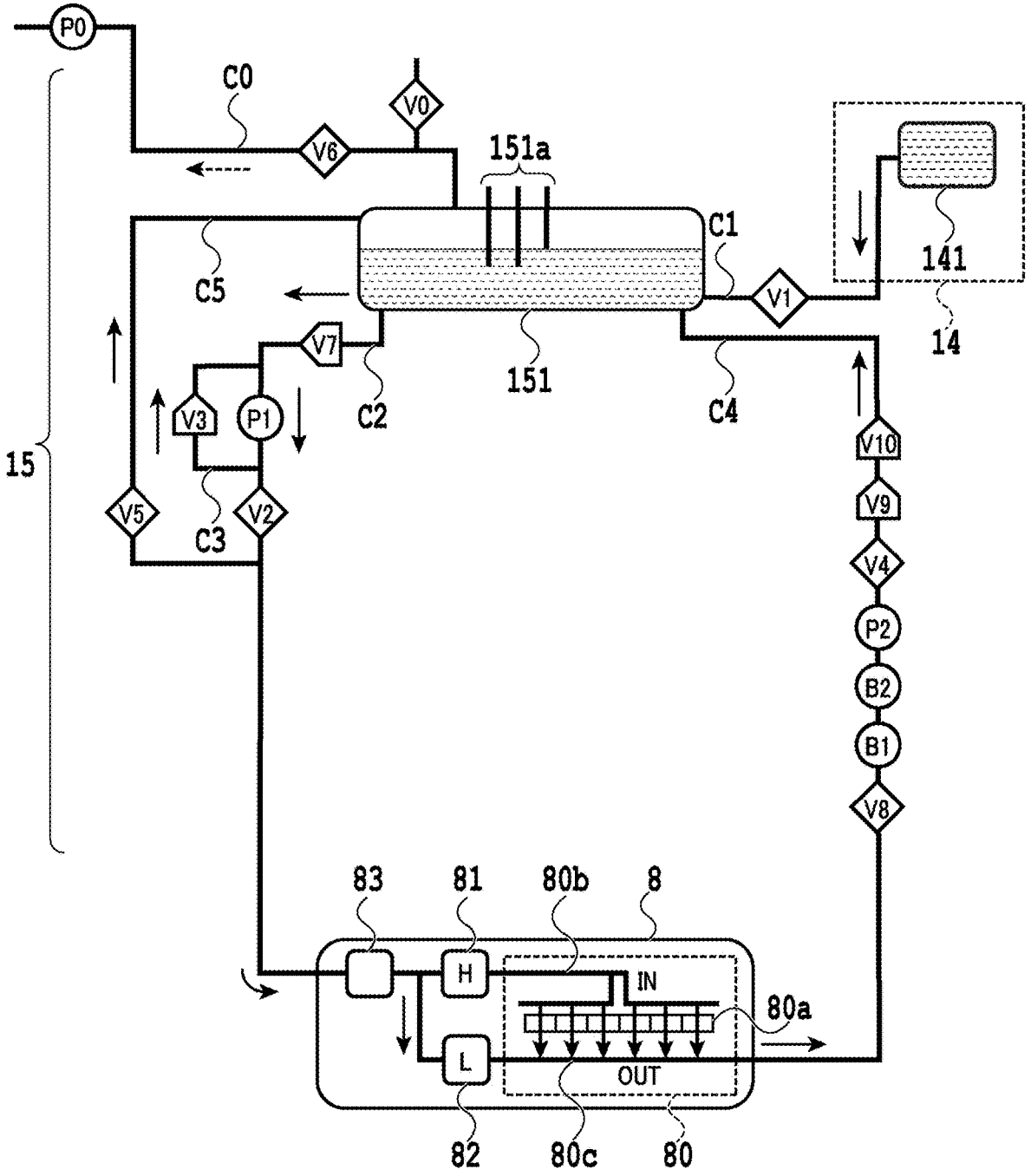
FIG. 5 is a diagram illustrating a flow path configuration of an ink circulation system.

FIG. 5 is a diagram including the ink supply unit 15 adopted in the inkjet printing apparatus 1 of the present embodiment. With reference of FIG. 5, a flow path configuration of an ink circulation system of the present embodiment will be described. The ink supply unit 15 supplies ink supplied from the ink tank unit 14 to the print head 8 (head unit). Although FIG. 5 shows a configuration for one color ink, such a configuration is practically prepared for each color ink. The ink supply unit 15 is basically controlled by the ink supply control unit 209 shown in FIG. 2. The following will describe the configuration of each component of the ink supply unit 15.

Ink is circulated mainly between a sub-tank 151 and the print head 8. In the print head 8, ink ejection operation is performed based on image data and ink that has not been ejected is collected back into the sub-tank 151.

The sub-tank 151 in which a certain amount of ink is contained is connected to a supply flow path C2 for supplying ink to the print head 8 and to a collection flow path C4 for collecting ink from the print head 8. In other words, a circulation path for circulating ink is provided by the sub-tank 151, the supply flow path C2, the print head 8, and the collection flow path C4. The sub-tank 151 is also connected to an air flow path C0 where air flows. The air flow path C0 is an atmosphere communication flow path where an atmosphere release valve V0 communicates with atmosphere.

A liquid level detection unit 151*a* including a plurality of electrode pins is provided in the sub-tank 151. The ink supply control unit 209 detects the presence/absence of a conducting current between those pins so as to grasp a height of an ink liquid level, that is, an amount of remaining ink inside the sub-tank 151. A vacuum pump P0 (an intratank vacuum pump) is a negative pressure generating source for reducing pressure inside the sub-tank 151. The atmosphere release valve V0 is a valve for switching between whether or not to make the inside of the sub-tank 151 communicate with atmosphere.

A main tank 141 is a tank that contains ink which is to be supplied to the sub-tank 151. The main tank 141 is configured to be detachable from the printing apparatus body. A tank supply valve V1 for switching connection between the sub-tank 151 and the main tank 141 is provided in the midstream of a tank connection flow path C1 connecting the sub-tank 151 and the main tank 141.

In a case where the liquid level detection unit 151*a* detects that the amount of ink inside the sub-tank 151 is less than a certain amount, the ink supply control unit 209 closes the atmosphere release valve V0, a supply valve V2, a collection valve V4, and a head replacement valve V5. Further, the ink supply control unit 209 opens the tank supply valve V1 and a sub-tank decompression valve V6. In this state, the ink supply control unit 209 causes the vacuum pump P0 to operate. This sets the pressure inside the sub-tank 151 to negative so that ink is supplied from the main tank 141 to the sub-tank 151. In a case where the liquid level detection unit 151*a* detects that the amount of ink inside the sub-tank 151 exceeds the certain amount, the ink supply control unit 209 closes the tank supply valve V1 and the sub-tank decompression valve V6, and stops the vacuum pump P0.

The supply flow path C2 is a flow path for supplying ink from the sub-tank 151 to the print head 8, and a supply pump P1 and the supply valve V2 are disposed in the midstream of the supply flow path C2. During print operation, driving the supply pump P1 in the state of the supply valve V2 being open allows ink circulation in the circulation path while supplying ink to the print head 8. The amount of ink to be ejected per unit time by the print head 8 varies according to image data. A flow rate of the supply pump P1 is determined so as to be adaptable even in a case where the print head 8 performs ejection operation in which ink consumption amount per unit time becomes maximum. A check valve V7 for preventing backflow of ink to the sub-tank 151 is disposed in the supply flow path C2. The check valve V7 is a valve for permitting the flow of ink only from one direction.

A relief flow path C3 is a flow path which is located in the upstream of the supply valve V2 and which connects between the upstream and downstream of the supply pump P1. A relief valve V3 which is a differential pressure valve is provided in the midstream of the relief flow path C3. The relief valve V3 is not opened or closed by a drive mechanism, but is urged by a spring. The relief valve V3 is configured to be opened in a case where the differential pressure reaches predetermined pressure. For example, in a case where the amount of ink supply from the supply pump P1 per unit time is larger than the total value of an ejection amount of the print head 8 per unit time and a flow rate (ink pulling-out amount) in a collection pump P2 per unit time, the relief valve V3 is released according to a pressure applied thereto. As a result, a cyclic flow path provided by a portion of the supply flow path C2 and the relief flow path C3 is formed. Providing the relief flow path C3 allows the amount of ink supply to the print head 8 to be adjusted according to the amount of ink consumed by the print head 8, thereby stabilizing the pressure inside the circulation path irrespective of image data.

The collection flow path C4 is a flow path for collecting ink from the print head 8 back to the sub-tank 151. The collection pump P2, the collection valve V4, a suction valve V8, and check valves V9 and V10 are disposed in the midstream of the collection flow path C4. Further, buffer chambers B1 and B2 are provided in the collection flow path C4. The collection pump P2 serves as a negative pressure generating source to suck ink from the print head 8 at the time of circulating ink within the circulation path. Driving the collection pump P2 generates an appropriate differential pressure between an IN flow path 80*b* and an OUT flow path 80*c* inside the print head 8, so that ink can be circulated between the IN flow path 80*b* and the OUT flow path 80*c*. A flow path configuration inside the print head 8 will be described later in detail.

The check valves V9 and V10 are valves for preventing backflow of ink back to the print head 8. In the present embodiment, the two check valves are provided preliminarily. The collection valve V4 is a valve for preventing backflow at the time of not performing print operation, that is, at the time of not circulating ink within the circulation path. In the circulation path of the present embodiment, the sub-tank 151 is disposed higher than the print head 8 in a vertical direction (see FIG. 1). As such, in a case where the supply pump P1 or the collection pump P2 is not driven, it is likely that ink flows back from the sub-tank 151 to the print head 8 due to a water head difference between the sub-tank 151 and the print head 8. In order to prevent such backflow, the check valves V9 and V10 and the collection valve V4 are provided in the collection flow path C4 in the present embodiment.

The supply valve V2 also serves as a valve for preventing ink supply from the sub-tank 151 to the print head 8 at the time of not performing print operation, that is, at the time of not circulating ink within the circulation path.

The suction valve V8 is controlled by the ink supply control unit 209 so as to be closed at the time of performing operation of capping and sucking the print head 8 by means of the cap unit 10 (not shown in FIG. 5). This control is performed to prevent ink in the flow path from being pulled into the cap unit 10 unnecessarily at the time of suction. At the time of suction, the supply valve V2 and the head replacement valve V5 are also controlled by the ink supply control unit 209 so as to be closed.

The buffer chamber B1, B2 is a component to reduce the influence of expansion and contraction of bubbles in ink in the flow path. The buffer chamber B1, B2 includes a compression spring and a flexible member such as a film, which expands or contracts according to the expansion and contraction of the compression spring. In a case where bubbles in ink in the flow path are expanded or contracted due to a change in temperature in a state where ink is not circulated, the buffer chambers B1 and B2 expand or contract following a change in volume of the bubbles in the flow path, thus changing their volumes. This can prevent ink leakage at the ejection opening or drawing of air from the ejection opening, which may be originated from a change in pressure applied to the ejection opening caused by expansion or contraction of bubbles. In the present embodiment, the two buffer chambers B1 and B2 are provided for expansion and contraction.

A head replacement flow path C5 is a flow path connecting the supply flow path C2 and an air chamber (space in which ink is not contained) of the sub-tank 151, with the head replacement valve V5 being disposed in the midstream of the head replacement flow path C5. One end of the head replacement flow path C5 is connected to the upstream of the print head 8 in the supply flow path C2 and to the downstream of the supply valve V2. The other end of the head replacement flow path C5 is connected to the upper part of the sub-tank 151 to communicate with the air chamber inside the sub-tank 151. The head replacement flow path C5 is used in the case of pulling out ink from the print head 8 in use such as at the time of replacement of the print head 8 or at the time of transportation of the printing apparatus 1. The head replacement valve V5 is controlled by the ink supply control unit 209 so as to be closed except for a case of filling ink in the print head 8 and a case of pulling out ink from the print head 8.

Next, a flow path configuration inside the print head 8 will be described. Ink supplied through the supply flow path C2 to the print head 8 passes through a filter 83 and is then supplied to a first negative pressure control unit 81 and a second negative pressure control unit 82. The first negative pressure control unit 81 has a control pressure set to a low negative pressure (negative pressure having a small pressure difference from atmospheric pressure). The second negative pressure control unit 82 has a control pressure set to a high negative pressure (negative pressure having a large pressure difference from atmospheric pressure). Pressures in those first negative pressure control unit 81 and second negative pressure control unit 82 are generated within an adequate range by the driving of the collection pump P2.

In an ink ejection unit 80, a plurality of printing element substrates 80*a* in each of which a plurality of ejection openings are arrayed are arranged to form an elongate ejection opening array. A common supply flow path 80*b* (IN flow path) for guiding ink supplied from the first negative pressure control unit 81 and a common collection flow path 80*c* (OUT flow path) for guiding ink supplied from the second negative pressure control unit 82 also extend in the direction of the array of the printing element substrates 80*a*. Furthermore, individual supply flow paths connected to the common supply flow path 80*b* and individual collection flow paths connected to the common collection flow path 80*c* are formed in each of the printing element substrates 80*a*. Accordingly, an ink flow is generated in each of the printing element substrates 80*a* such that ink flows in from the common supply flow path 80*b* which has relatively lower negative pressure and flows out to the common collection flow path 80*c* which has relatively higher negative pressure. A pressure chamber which communicates with each ejection opening and which is filled with ink is provided in the midstream of a path between the individual supply flow path and the individual collection flow path, so that an ink flow is generated even in the ejection opening and the pressure chamber where printing is not performed. Once the ejection operation is performed in the printing element substrate 80*a*, a part of ink moving from the common supply flow path 80*b* to the common collection flow path 80*c* is ejected from the ejection opening to be consumed; meanwhile, ink that has not been ejected moves toward the collection flow path C4 through the common collection flow path 80*c*.

Figure 6A:
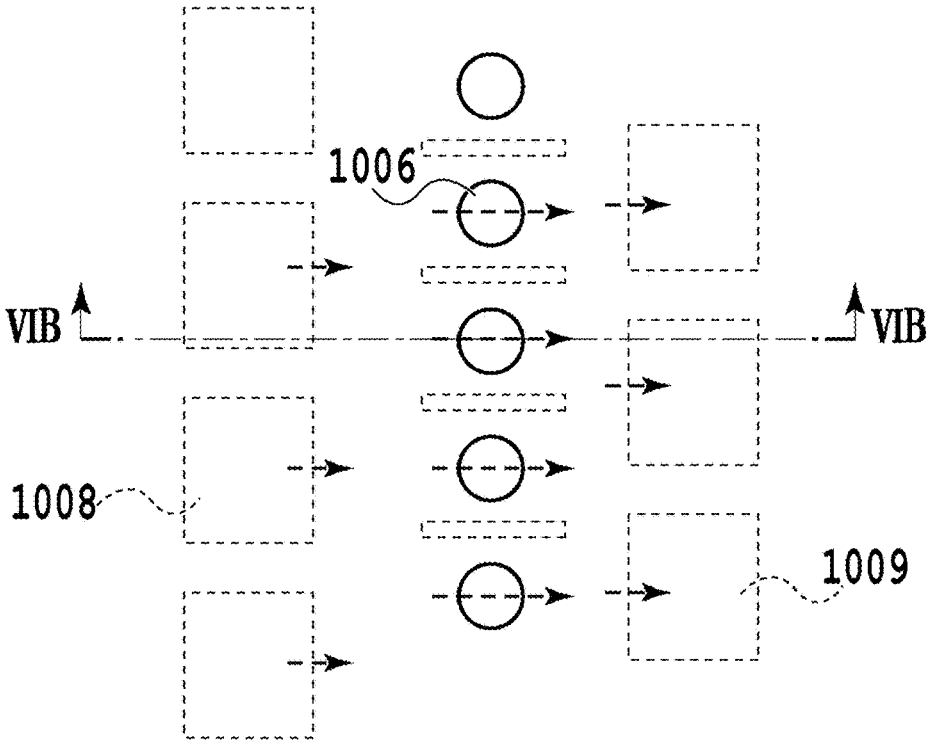
FIGS. 6A and 6B are diagrams illustrating an ejection opening and a pressure chamber.
Figure 6B:
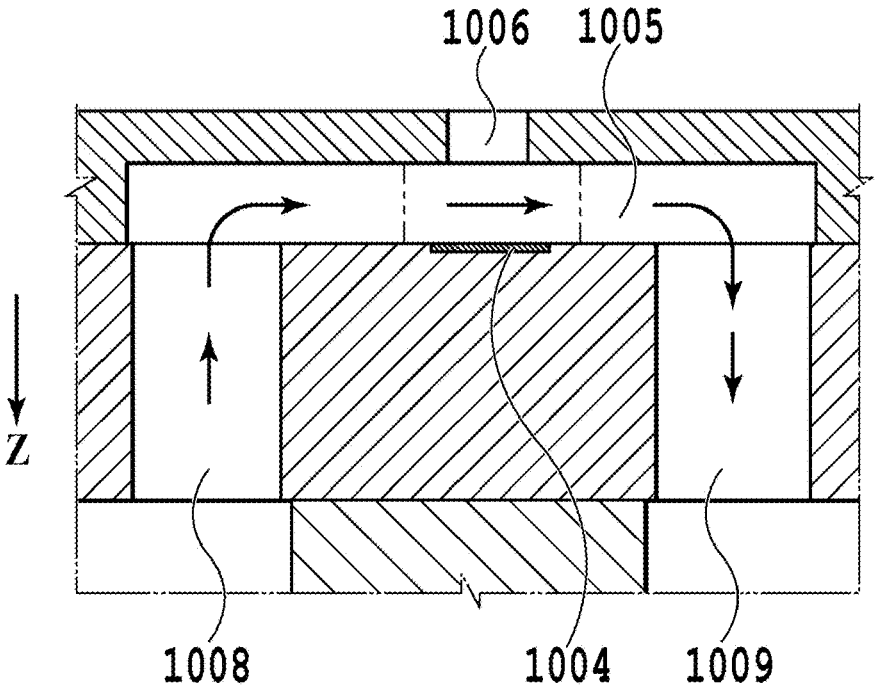

FIG. 6A is a plan schematic view showing in enlargement a part of the printing element substrate 80*a*, and FIG. 6B is a cross-sectional schematic view along line VIB-VIB in FIG. 6A. A pressure chamber 1005 which is filled with ink and an ejection opening 1006 from which ink is ejected are provided in the printing element substrate 80*a*. A printing element 1004 is provided in the pressure chamber 1005 at a position facing the ejection opening 1006. Further, in the printing element substrate 80*a*, a plurality of individual supply flow paths 1008 each of which is connected to the common supply flow path 80*b* and a plurality of individual collection flow paths 1009 each of which is connected to the common collection flow path 80*c* are formed for the respective ejection openings 1006.

The foregoing configuration generates, in the printing element substrate 80*a*, an ink flow such that ink flows in from the common supply flow path 80*b* which has relatively low negative pressure (whose absolute value is high) and flows out to the common collection flow path 80*c* which has relatively high negative pressure (whose absolute value is low). To be more specific, ink flows in the order of the common supply flow path 80*b*, the individual supply flow path 1008, the pressure chamber 1005, the individual collection flow path 1009, and the common collection flow path 80*c*. Once ink is ejected by the printing element 1004, part of ink moving from the common supply flow path 80*b* to the common collection flow path 80*c* is ejected from the ejection opening 1006 to be discharged outside the print head 8. Meanwhile, ink which has not been ejected from the ejection opening 1006 is collected into the collection flow path C4 through the common collection flow path 80*c*.

At a time of performing print operation, the ink supply control unit 209 closes the tank supply valve V1, the head replacement valve V5 and the sub-tank decompression valve V6, opens the atmosphere release valve V0, the supply valve V2, the collection valve V4, and the suction valve V8, and drives the supply pump P1 and the collection pump P2. As a result, a circulation path of the sub-tank 151, the supply flow path C2, the print head 8, the collection flow path C4, and the sub-tank 151 is established. In a case where the amount of ink supply per unit time from the supply pump P1 is larger than the total value of the ejection amount per unit time of the print head 8 and the flow rate per unit time in the collection pump P2, ink flows into the relief flow path C3 from the supply flow path C2. Accordingly, the flow rate of the ink flowing into the print head 8 from the supply flow path C2 is adjusted.

In a case where print operation is not performed, the ink supply control unit 209 stops the supply pump P1 and the collection pump P2 and closes the atmosphere release valve V0, the supply valve V2, the collection valve V4, and the suction valve V8. As a result, the flow of ink in the print head 8 is stopped, and the backflow due to the water head difference between the sub-tank 151 and the print head 8 is also suppressed. In addition, closing the atmosphere release valve V0 suppresses ink leakage and evaporation of ink from the sub-tank 151.

At the time of pulling out ink from the print head 8, the ink supply control unit 209 closes the atmosphere release valve V0, the tank supply valve V1, the supply valve V2, the collection valve V4, and the suction valve V8, opens the head replacement valve V5, and drives the vacuum pump P0. As a result, the interior of the sub-tank 151 goes into a negative pressure state, and the ink in the print head 8 is collected back to the sub-tank 151 through the head replacement flow path C5. As apparent from the above, the head replacement valve V5 is a valve which is closed during the normal print operation and in the standby state, and is opened at the time of pulling out ink from the print head 8. The head replacement valve V5 is also opened at the time of filling ink in the head replacement flow path C5 in filling ink in the print head 8.

(Arrangement of Ink Supply Unit)

Figure 7:
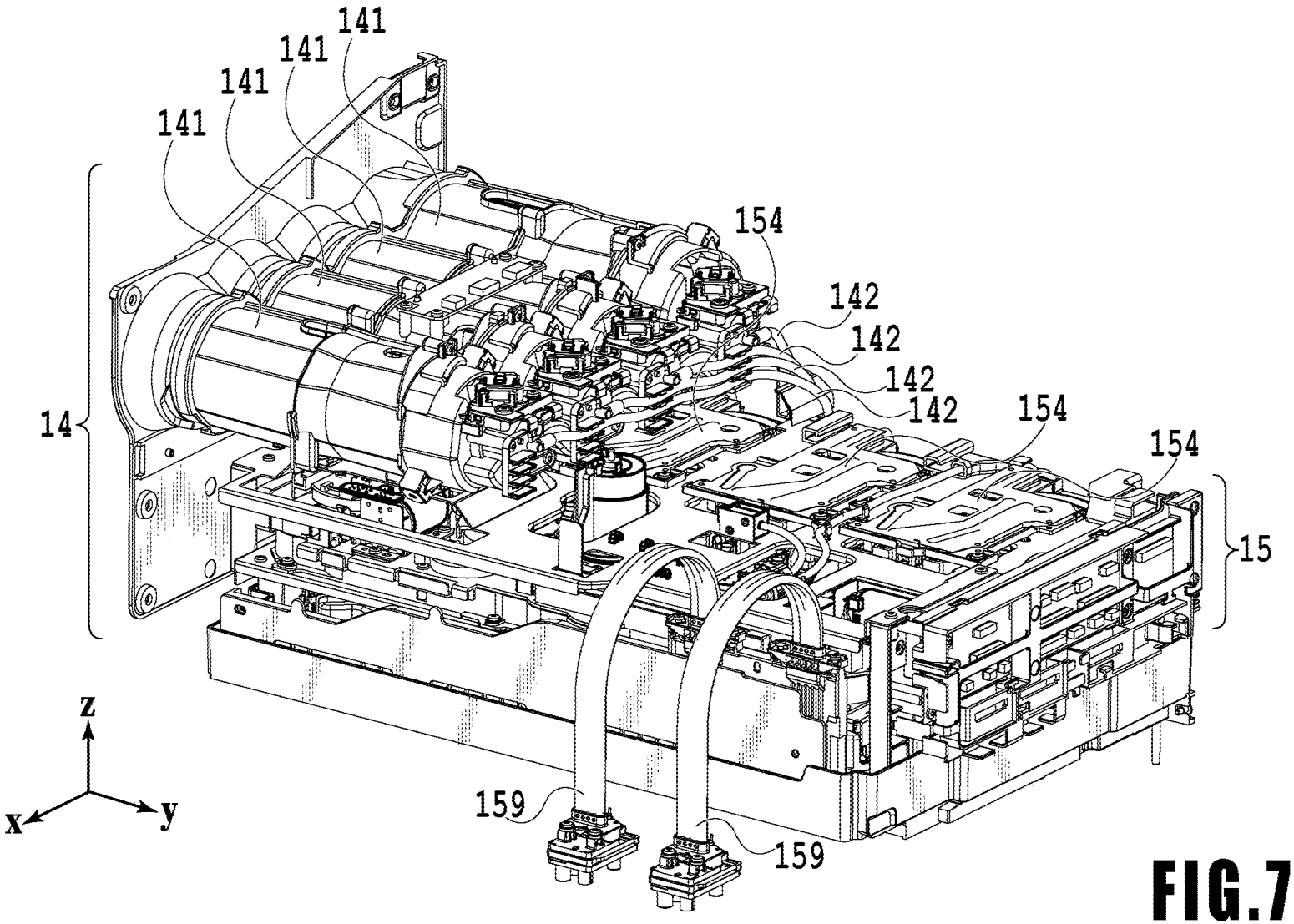
FIG. 7 is a perspective view of an ink tank unit and an ink supply unit.
Figure 8:
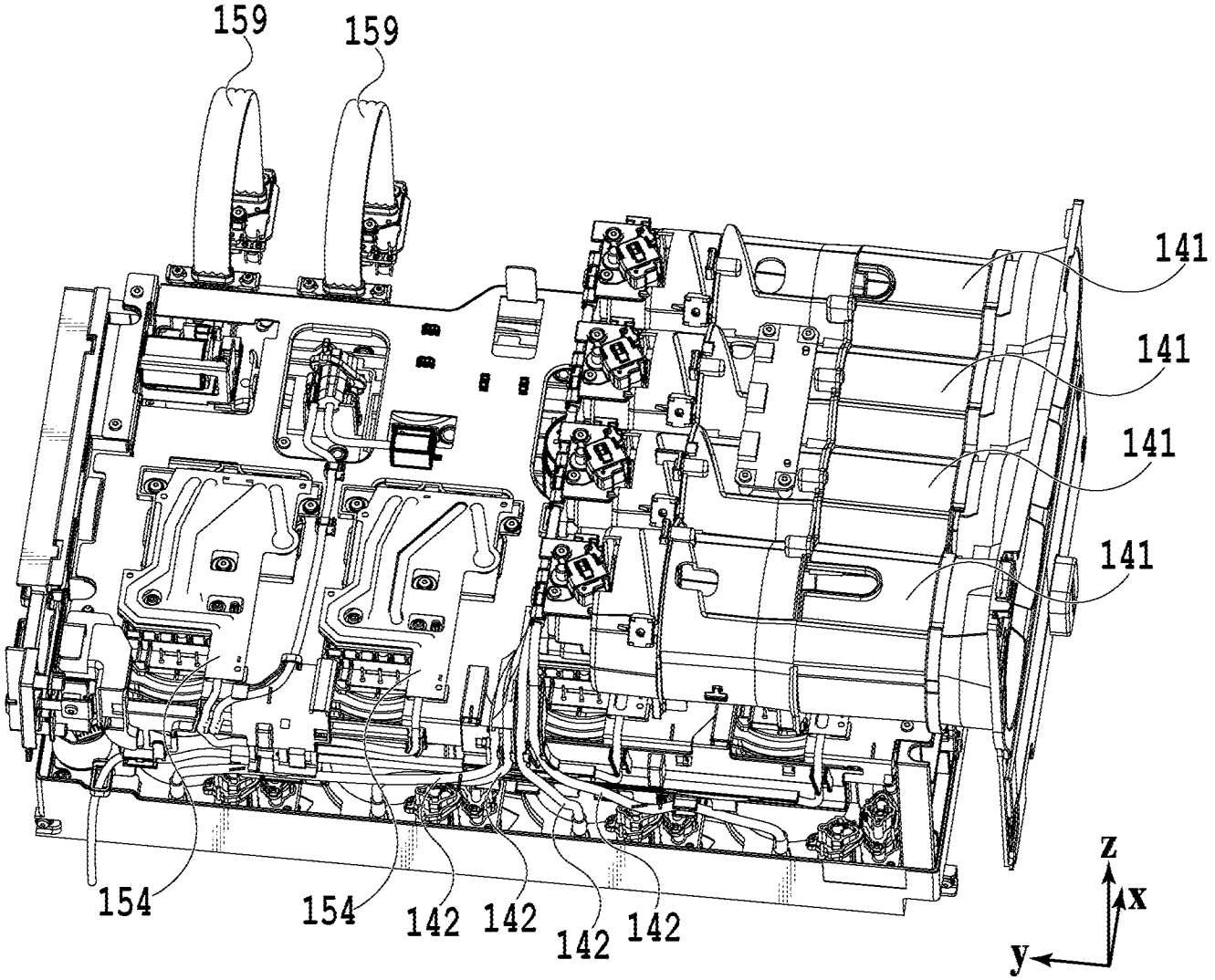
FIG. 8 is a perspective view of the ink tank unit and the ink supply unit.

FIGS. 7 and 8 are perspective views including the ink tank unit 14 and the ink supply unit 15. Ink is supplied from the main tank 141 of each color of the ink tank unit 14 to the ink supply unit 15 through the supply tube 142. That is, the tank connection flow path c1 for supplying ink from the main tank 141 to the sub-tank 151 is formed in the supply tube 142. As shown in FIG. 7, the ink supply unit 15 is disposed below the ink tank unit 14 in the gravitational direction. Hereinafter, in the case of simply referring to "upper" and "lower," it indicates upper and lower in the gravitational direction (z-direction). The arrangement and configuration of the ink supply unit 15 will be described later. In the ink supply unit 15, a linkage tube 159 is provided for each of the supply flow path C2 and the collection flow path C4. In the linkage tube 159, flow paths are partitioned according to the inks of the individual colors. That is, the supply flow paths C2 corresponding to the individual colors are formed in one linkage tube 159, and the collection flow paths C4 corresponding to the individual colors are formed in the other linkage tubes 159. The linkage tubes 159 are connected to the print head 8 (not shown in FIGS. 7 and 8). In FIGS. 7 and 8, the atmosphere communication plate 154 is disposed above the ink supply unit 15. Details of the atmosphere communication plate 154 will be described later.

Figure 9A:
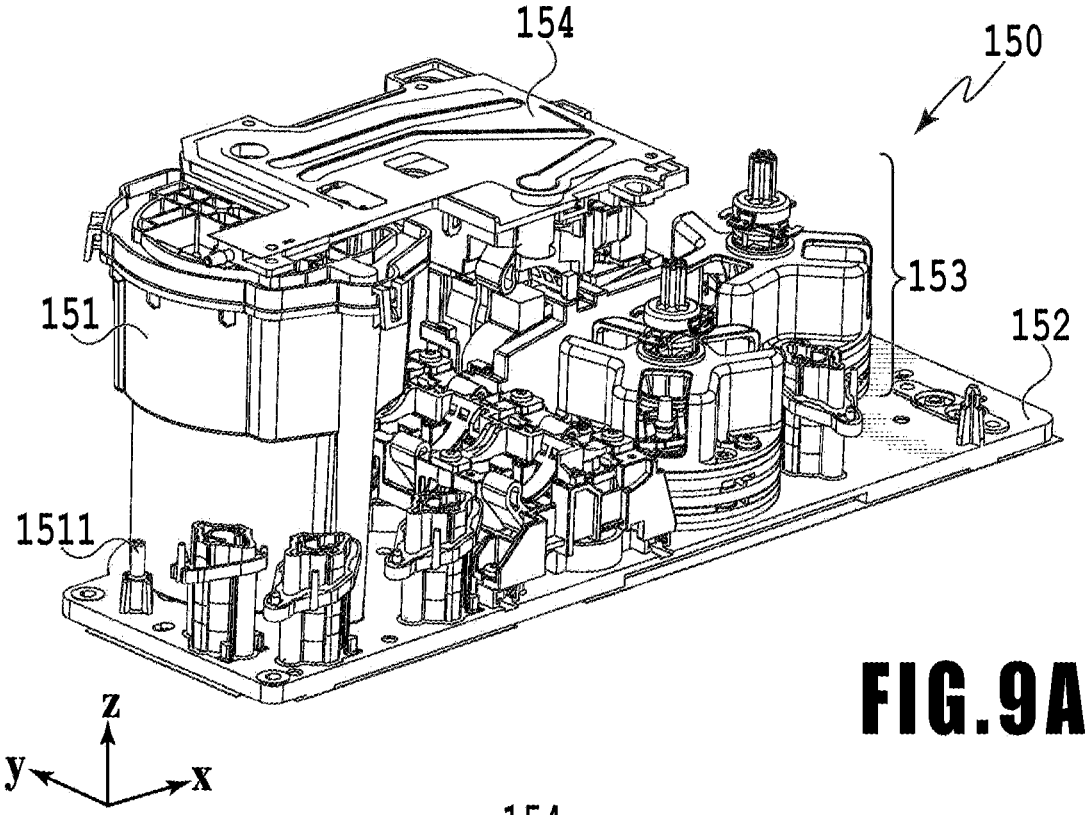
FIGS. 9A and 9B are perspective views of a subunit.
Figure 9B:
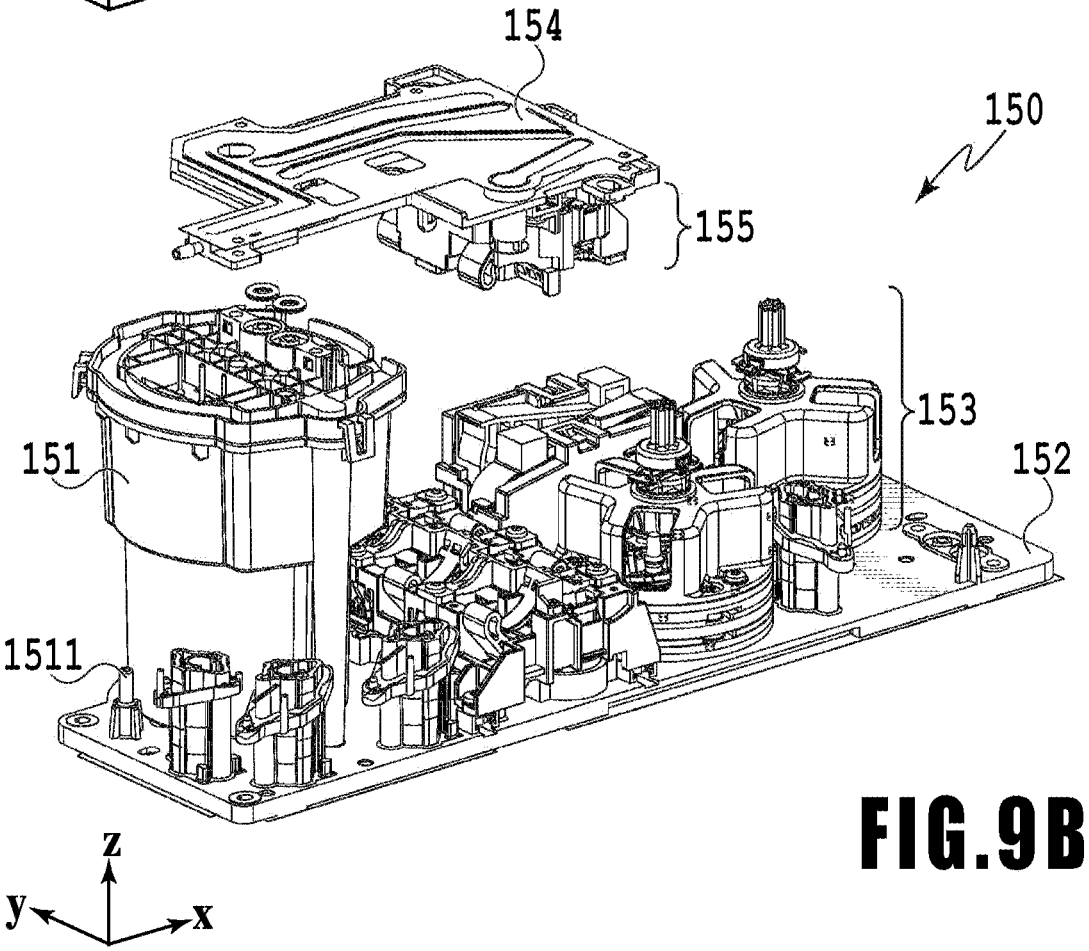

FIG. 9A is a perspective view of a subunit 150 constituting the ink supply unit 15. FIG. 9B is a perspective view of the state in which the atmosphere communication plate 154 of FIG. 9A is separated from the subunit 150. The subunit 150 is provided for each ink color. The figures show the subunit 150 corresponding to an arbitrary ink color. The subunit 150 includes a sub-tank 151, an ink flow path plate 152 disposed below the sub-tank 151, and an atmosphere communication plate 154 disposed above the sub-tank 151. A tube connecting portion 1511 for connecting the supply tube 142 (see FIGS. 7 and 8) connected to the main tank 141 is disposed on the ink flow path plate 152. Ink is supplied to the sub-tank 151 through the tank connection flow path c1 formed in the ink flow path plate 152. The supply flow path C2 for supplying ink from the sub-tank 151 to the print head 8 and the collection flow path C4 for collecting ink from the print head 8 to the sub-tank 151 are formed in the ink flow path plate 152. The air flow path C0 through which air flows is formed in the atmosphere communication plate 154.

As shown in FIGS. 9A and 9B, in this embodiment, the sub-tank 151 and a first functional component group 153 are disposed above the ink flow path plate 152. The first functional component group 153 is a generic name of first functional components which act on the flow paths. First functional components included in the first functional component group 153 are, for example, a drive valve, a differential pressure valve, a check valve for opening and closing a flow path by using a drive mechanism, circulation pumps used for circulation (supply pump P1 and collection pump P2), and buffer chambers B1 and B2. The drive valves included in the first functional component group 153 are, for example, the tank supply valve V1, the supply valve V2, the collection valve V4, the head replacement valve V5, and the suction valve V8. The differential pressure valve included in the first functional component group 153 is, for example, the relief valve V3. The check valve is also a type of differential pressure valve, and the check valve V7, the check valve V9, and the check valve V10 are also included in the differential pressure valves. In this manner, the first functional component group 153 includes the first functional component which acts on the tank connection flow path C1, the supply flow path C2, the relief flow path C3, the collection flow path C4, and the head replacement flow path C5. Connecting portions between the supply flow path C2, and the relief flow path C3 and the head replacement flow path C5 are provided in the ink flow path plate 152 (not shown).

Further, as shown in FIGS. 9A and 9B, in the present embodiment, a second functional component group 155 is arranged below the atmosphere communication plate 154. The second functional component group 155 is a generic name of second functional components which act on the flow paths. Second functional components included in the second functional component group 155 are, for example, drive valves for opening and closing flow paths by using the drive mechanism. The drive valves included in the second functional component group 155 are, for example, the air release valve V0 and the sub-tank decompression valve V6. Accordingly, the second functional component group 155 includes a second functional component which acts on the air flow path C0.

The sub-tank 151, the ink flow path plate 152, the atmosphere communication plate 154, the first functional component group 153, and the second functional component group 155 shown in FIGS. 9A and 9B are provided for each ink color. In the present embodiment, the main tank 141, the sub-tank 151, the ink flow path plate 152, the atmosphere communication plate 154, the first functional component group 153, and the second functional component group 155 are configured in common for every ink color. Designing the common configuration of the subunit 150 to all the ink colors makes it possible to reduce the cost of the subunits 150 as compared with the case of preparing subunits 150 having different configurations for different ink colors. It should be noted that the functional components included in the first functional component group 153 and the second functional component group 155 described above are mere examples and some of the functional components may not be provided, and functional components other than those in this example may be provided.

Figure 10:
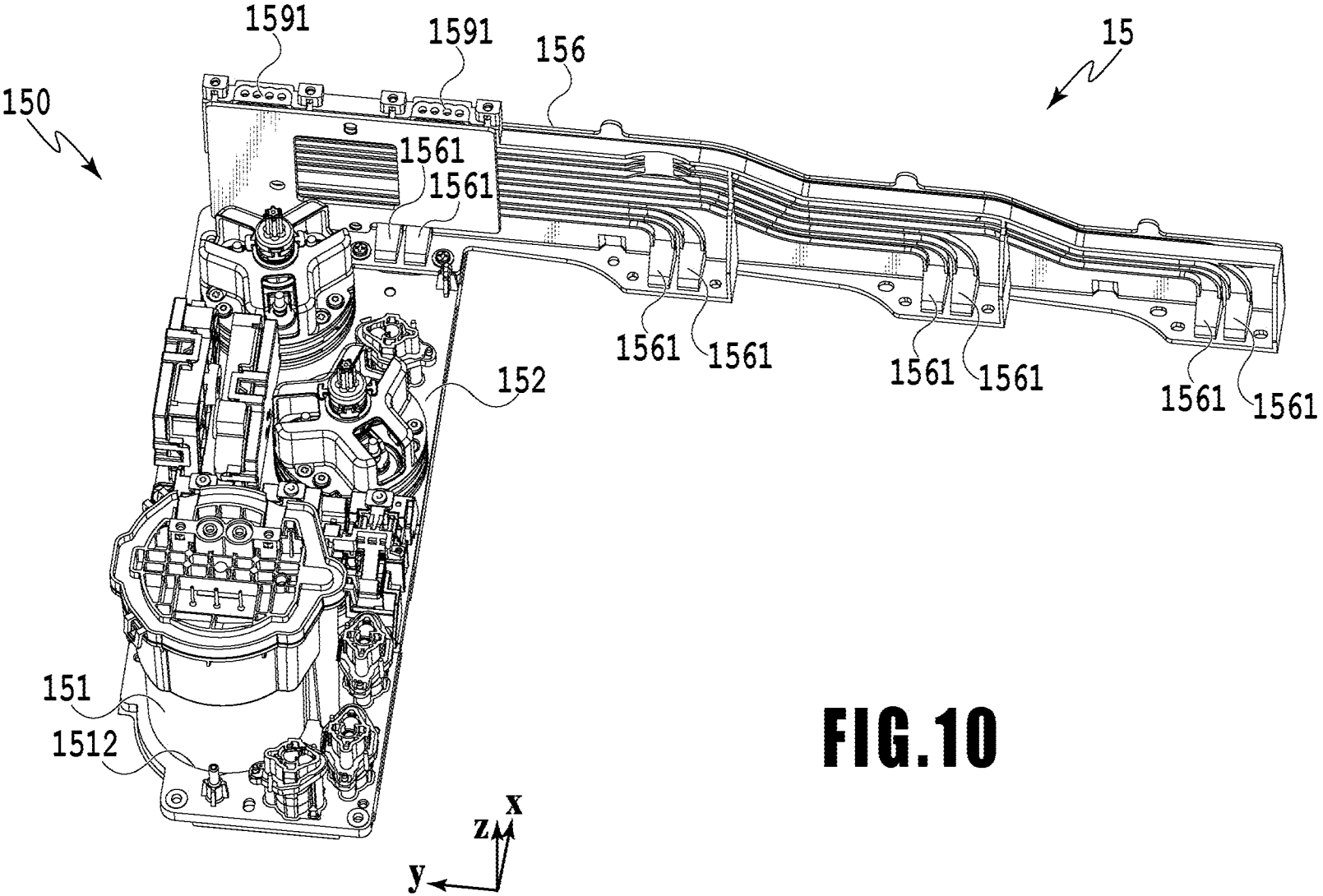
FIG. 10 is a perspective view of the ink supply unit.

FIG. 10 is a perspective view of the ink supply unit 15. The ink supply unit 15 further includes a flow path aggregation plate 156 in addition to the subunit 150 (only one subunit 150 for one color is shown in FIG. 10) for each ink color. In the present embodiment, the subunits 150 having the same arrangement and configuration are arranged in the same direction in the y-direction (horizontal direction).

The sub-tank 151 is disposed above substantially one end portion of the ink flow path plate 152. That is, a connecting portion between the sub-tank 151 and the ink flow path plate 152 (hereinafter referred to as first connecting portion 1512; also see FIGS. 11A to 11C) is provided on the bottom surface of the sub-tank 151. Flow paths (supply flow path C2 and collection flow path C4) are formed in the ink flow path plate 152 so as to extend in the horizontal direction (x-direction) from the first connection portion 1512 connected to the sub-tank 151. It is to be noted that the flow paths as a whole extend in the x-direction and may be guided in another direction halfway. As shown in FIG. 10, at an end portion on the opposite side in the x-direction of an end portion where the first connection portion 1512 of the ink flow path plate 152 is provided, a connecting portion for connecting the flow path inside the ink flow path plate 152 to the flow path aggregation plate 156 (hereinafter referred to as second connecting portion 1561) is provided.

The flow path aggregation plate 156 is disposed above the ink flow path plate 152 of each subunit 150 so as to traverse the second connecting portions 1561. A flow path for guiding the ink fed to each second connecting portion 1561 or the ink delivered from each second connecting portion 1561 in a substantially horizontal direction (y-direction) is formed in the flow path aggregation plate 156. As shown in FIG. 10, all the flow paths are arranged side by side in the z-direction in the flow path aggregation plate 156. The flow path aggregation plate 156 includes a third connecting portion 1591 to be connected to the linkage tube 159 (see FIGS. 7 and 8).

In this manner, the supply flow path C2 and the collection flow path C4 are formed in the ink flow path plate 152, the flow path aggregation plate 156, and the linkage tube 159.

(Arrangement of Ink Flow Path Plate)

Figure 11A:
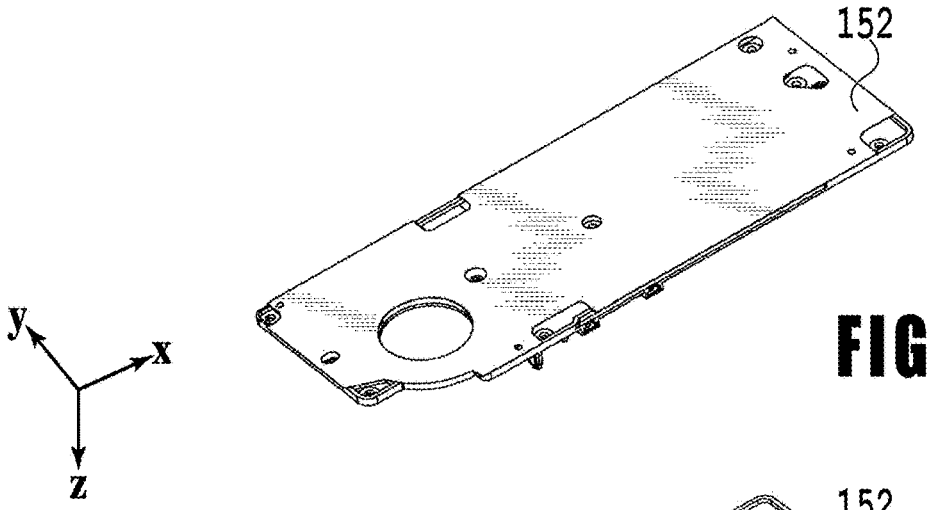
FIGS. 11A, 11B and 11C are perspective views illustrating the configuration of an ink flow path plate.
Figure 11B:
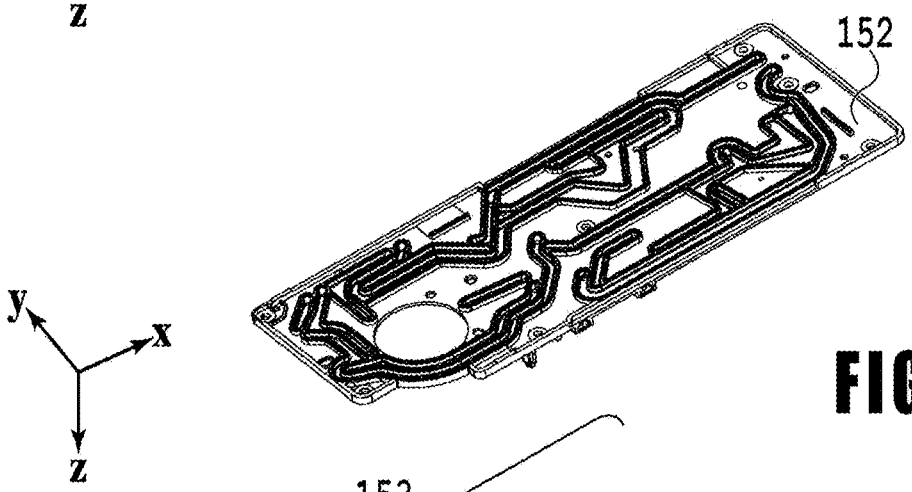
Figure 11C:
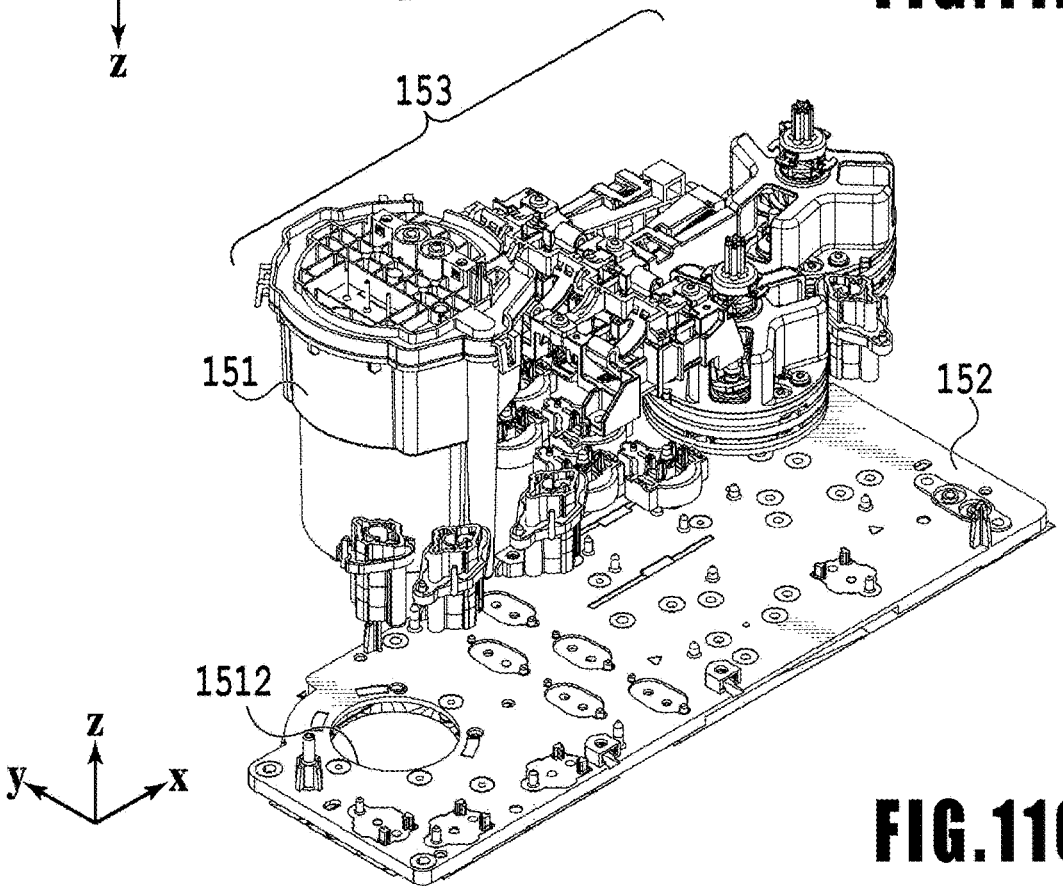

FIGS. 11A to 11C are perspective views illustrating a configuration of the ink flow path plate 152. FIG. 11A is a view of the ink flow path plate 152 as viewed from below in the gravitational direction. FIG. 11B is a view in which the flow path is visualized through the film member on the surface of FIG. 11A. FIG. 11C is a view of the ink flow path plate 152 as viewed from above in the gravitational direction. FIG. 11C shows a view in which the sub-tank 151 and the first functional component group 153 arranged on the ink flow path plate 152 are separated.

Figure 12A:
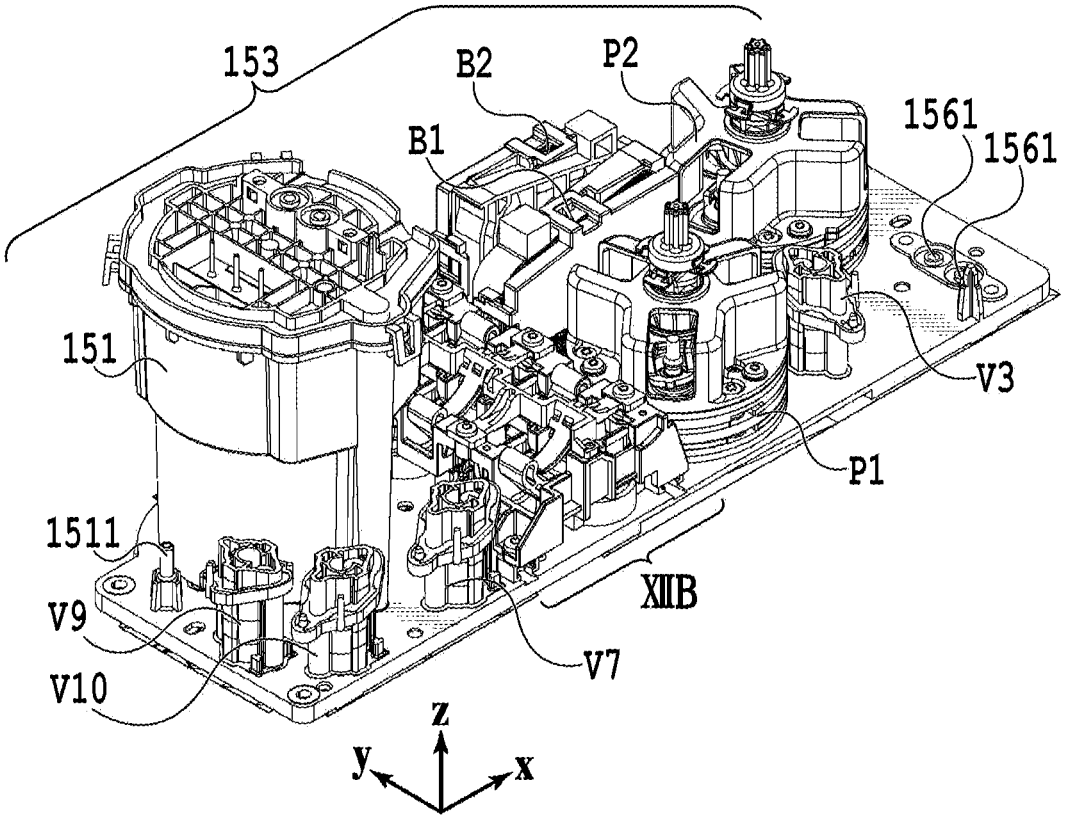
FIGS. 12A and 12B are perspective views illustrating the configuration of the ink flow path plate.
Figure 12B:
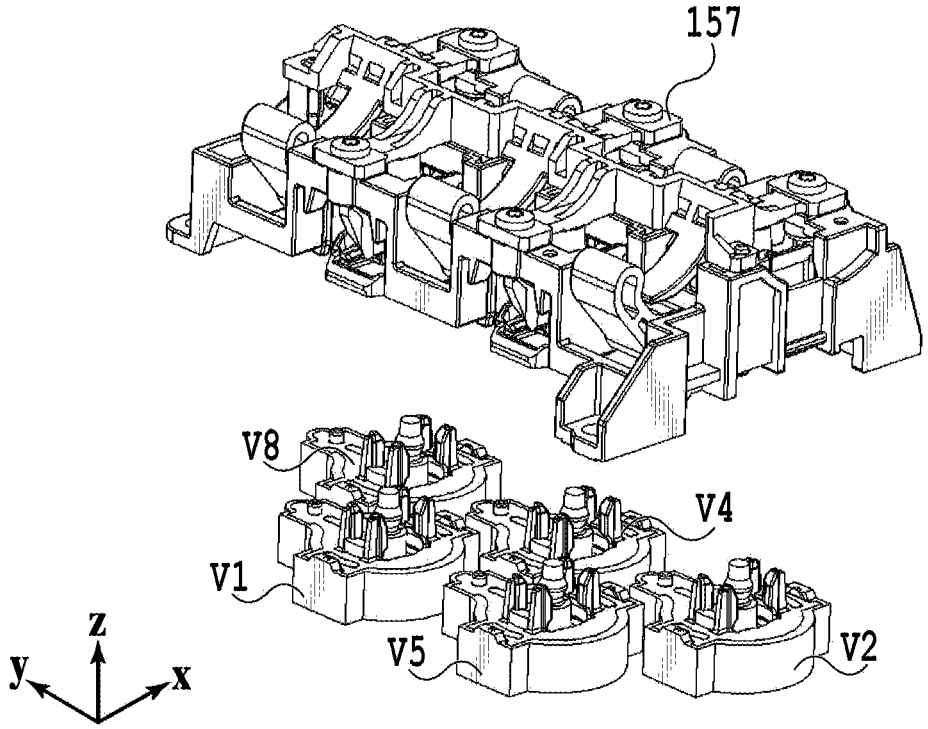

FIGS. 12A and 12B are perspective views in which the sub-tank 151 and the first functional component group 153 are disposed on the ink flow path plate 152. In FIGS. 12A and 12B, components corresponding to the drive valve, the differential pressure valve, the check valve, the buffer chamber, and the circulation pump shown in FIG. 5 are denoted by the same symbols as given in FIG. 5. FIG. 12B is an exploded perspective view of a XIIB portion of FIG. 12A. Drive valves are disposed in the lever holder 157. Although not shown, a flow path leading to the upper part of the sub-tank 151 is formed in the sub-tank 151; for example, the head replacement flow path C5 is connected to the upper air chamber in the sub-tank 151 from the ink flow path plate 152 through the flow path in the sub-tank 151.

As shown in FIGS. 12A and 12B, the first functional component group 153 is disposed above the ink flow path plate 152. The first functional component group 153 is a group of components that control the opening and closing of the flow path and control the flow rate of ink flowing through the flow path. Therefore, the first functional component group 153 is disposed above the position corresponding to the flow path formed in the ink flow path plate 152. As apparent from the above, in the present embodiment, the first functional component group 153 which acts on the flow paths related to the flow of ink (the tank connection flow path C1, the supply flow path C2, the relief flow path C3, the collection flow path C4, and the head replacement flow path C5) is disposed in aggregation above the ink flow path plate 152. The following will describe the reason why such an arrangement is adopted.

The ink supply unit 15 of the present embodiment is provided with the sub-tank 151 that stores circulating ink. As shown in FIGS. 12A and 12B, etc., the sub-tank 151 is an elliptical tank elongated in the z-direction.

Figure 13:
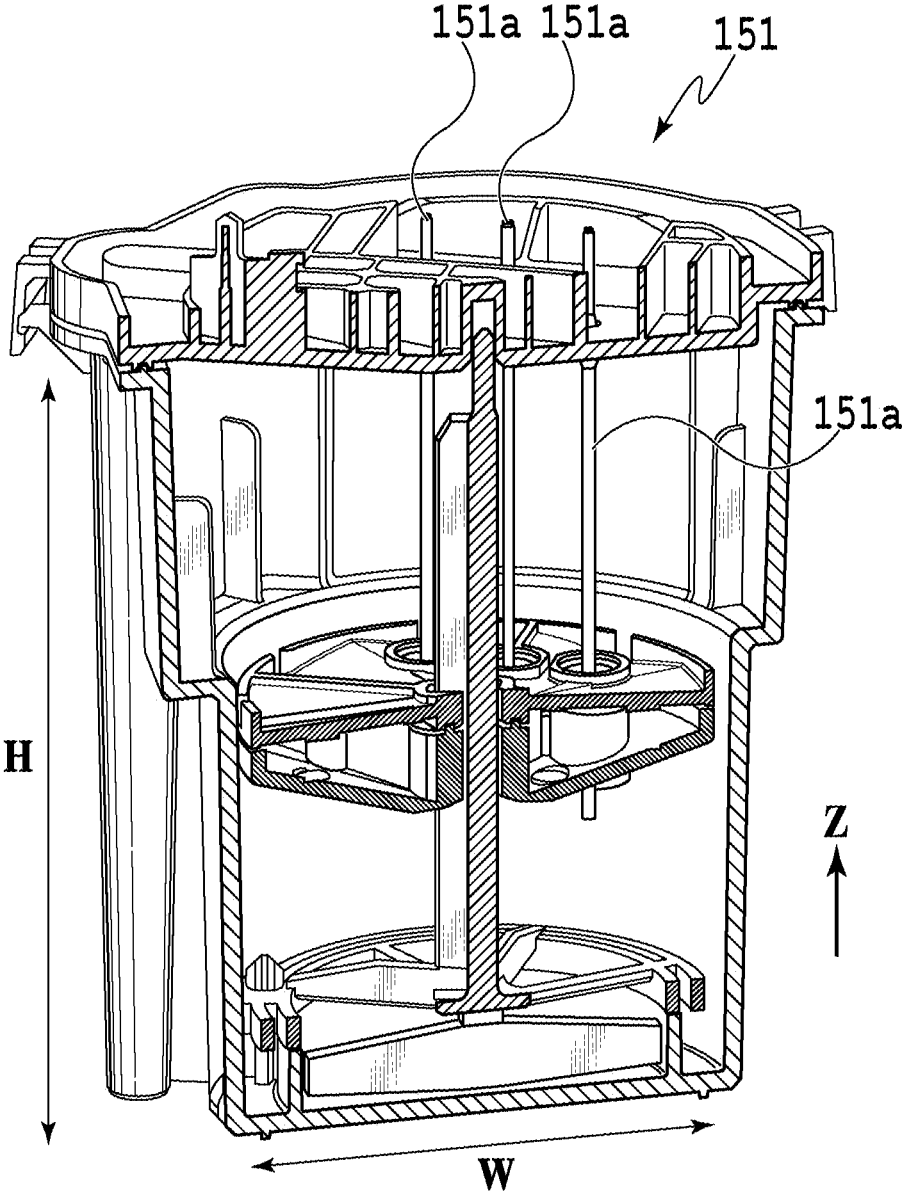
FIG. 13 is a diagram showing the longitudinal cross section of a sub-tank.

FIG. 13 is a view showing the longitudinal cross section of the sub-tank 151. Three liquid level detection units 151*a* (electrode pins) are inserted in the sub-tank 151. The region in which the liquid in the sub-tank 151 is stored has a cylindrical shape or an elliptic cylindrical shape, and may have a width W of about 80 mm and a height H of about 100 mm. As apparent from the above, the sub-tank 151 having a shape elongated in the z-direction (gravitational direction or height direction) is used in this embodiment. The reason for using such a sub-tank 151 is to increase the accuracy of detecting the remaining amount of ink in the sub-tank 151 with the liquid level detection units 151*a*. In a case where a sub-tank 151 having a shape elongated in the x-direction or the y-direction (horizontal direction) is used, the amount of a change in level in the height direction with respect to an increase or a decrease in unit ink amount becomes small. That is, the accuracy of detecting the remaining amount of ink in the sub-tank 151 becomes low. In order to improve the accuracy of detecting the remaining amount of ink, therefore, the sub-tank 151 having a shape elongated in the z-direction is used. In a case where the sub-tank 151 having a shape elongated in the z-direction is used, a space is formed above a horizontal region adjacent to the region where the sub-tank 151 is disposed, in correspondence to that length. In the present embodiment, the space corresponding to the length in the z-direction (gravitational direction) which is formed by the sub-tank 151 is effectively used.

As an example of effective utilization, first, the flow paths related to the flow of ink in the ink supply unit 15 are aggregated in the ink flow path plate 152 in this embodiment. Further, a flow path related to the air flow of the ink supply unit 15 is formed in the atmosphere communication plate 154. Then, the sub-tank 151 is disposed above the ink flow path plate 152, and the atmosphere communication plate 154 is disposed above the sub-tank 151 (see FIGS. 9A and 9B). Sandwiching the sub-tank 151 between the atmosphere communication plate 154 and the ink flow path plate 152 in the gravitational direction in this way prevents the size of the ink supply unit 15 from being enlarged in the gravitational direction. Therefore, the ink supply unit 15 can be made compact. Furthermore, the first functional component group 153 is disposed above the ink flow path plate 152 in this embodiment. More specifically, the first functional component group 153 is disposed in a region which is above the ink flow path plate 152 and in which the sub-tank 151 is not disposed. That is, the first functional component group 153 is disposed in aggregation in a horizontal spatial region adjacent to the sub-tank 151 and formed by the sub-tank 151, the ink flow path plate 152, and the atmospheric communication plate 154. Arranging the subunits 150 in this way makes it possible to effectively utilize the space in the z-direction (gravitational direction) formed by the sub-tank 151.

(Arrangement of Atmosphere Communication Plate)

Figure 14A:
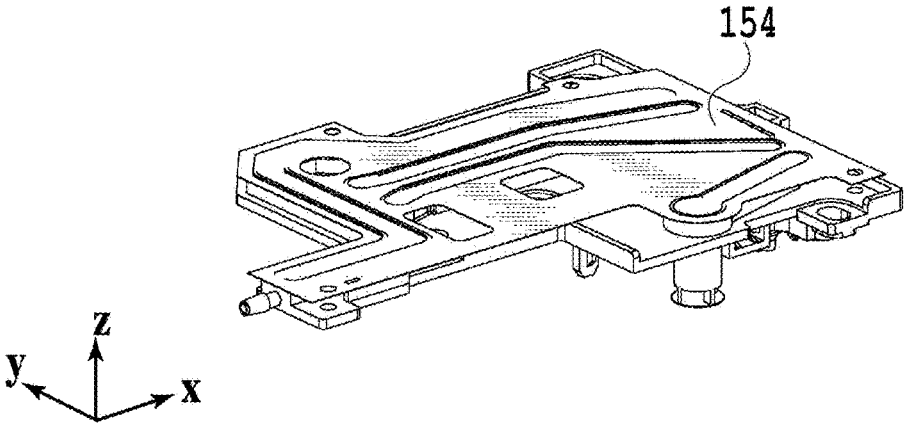
FIGS. 14A, 14B and 14C are perspective views illustrating the configuration of an atmosphere communication plate.
Figure 14B:
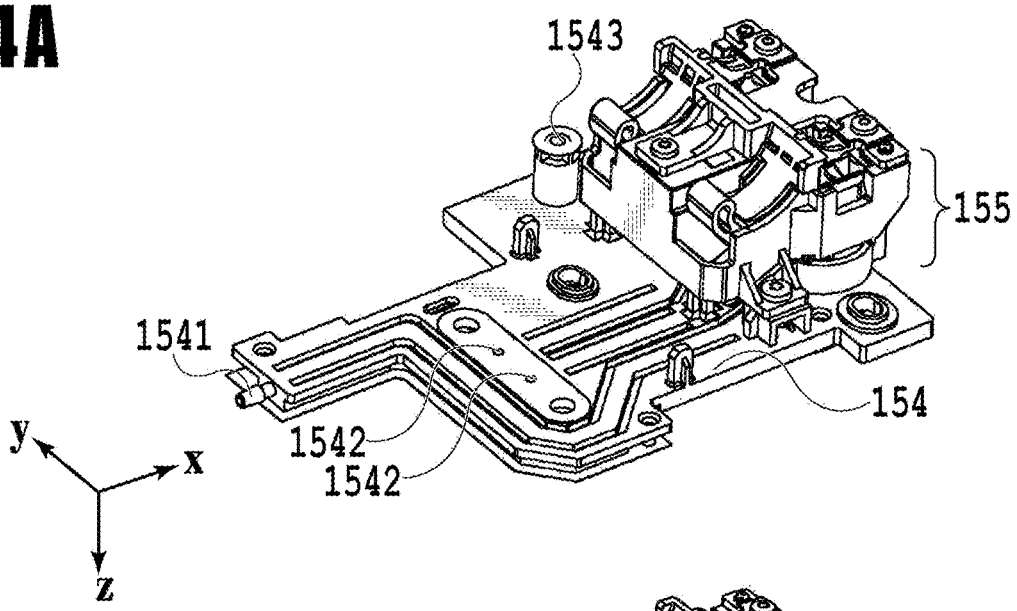
Figure 14C:
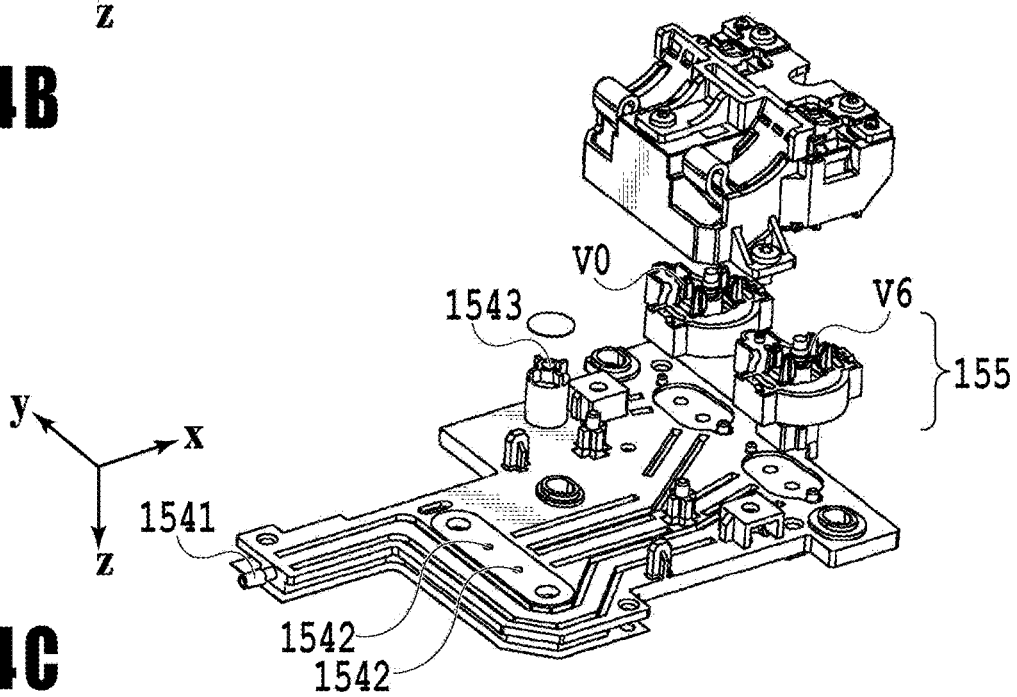

FIGS. 14A to 14C are views illustrating the configuration of the atmosphere communication plate 154. FIG. 14A is a perspective view of the atmosphere communication plate 154 as viewed from above in the gravitational direction. In FIG. 14A, illustration of the second functional component group 155 is omitted. FIG. 14B is a perspective view of the atmosphere communication plate 154 on which the second functional component group 155 is disposed, as viewed from below in the gravitational direction. That is, in a case where the atmosphere communication plate 154 is connected to the sub-tank 151, the connection is made with the state of FIG. 14B reversed. FIG. 14B shows, for the sake of description, a view as seen from below in the gravitational direction. FIG. 14C is an exploded perspective view of FIG. 14B. Disposed on the atmosphere communication plate 154 are a pump connecting portion 1541 for connection with the vacuum pump P0, a sub-tank connecting portion 1542 for connection with the sub-tank 151, an atmosphere communication hole 1543 communicating with the atmosphere, and the second functional component group 155. The sub-tank connecting portion 1542 is connected to the top surface of the sub-tank 151 in the gravitational direction.

The atmosphere communication plate 154 is disposed above the sub-tank 151 in the gravitational direction (see also FIGS. 9A and 9B). The second functional component group 155 which acts on the air flow path C0 is disposed below the atmospheric communication plate 154 in the gravitational direction. Generally, as apparent from the ink flow path plate 152 in FIGS. 9A and 9B, functional components that act on the flow path are disposed above the flow path in the gravitational direction. In the present embodiment, however, the second functional component group 155 which act on the air flow path C0 is disposed below the atmospheric communication plate 154 in the gravitational direction. That is, the second functional component group 155 is disposed in aggregation in the horizontal spatial region adjacent to the sub-tank 151, which is formed by the sub-tank 151, the ink flow path plate 152, and the atmosphere communication plate 154.

As described above, in the present embodiment, the sub-tank 151 is disposed so as to be sandwiched between the atmosphere communication plate 154 and the ink flow path plate 152 in the gravitational direction. Further, the first functional component group 153 and the second functional component group 155 are disposed in aggregation in the horizontal spatial regions adjacent to the sub-tank 151, which are formed by the sub-tank 151, the ink flow path plate 152, and the atmosphere communication plate 154. Accordingly, the gravitational-directional length (size) of the ink supply unit 15 falls within the size substantially corresponding to the gravitational-directional size of the sub-tank 151 (more specifically, that size added with the gravitational-directional sizes of the air communication plate 154 and the ink flow path plate 152). Therefore, it is possible to provide the ink supply unit 15 which has the gravitational-directional size made compact. In a case where the second functional component group 155 is disposed above the atmosphere communication plate 154 in the gravitational direction, the gravitational-directional size of the ink supply unit 15 becomes larger by the gravitational-directional size of the second functional component group 155. The present embodiment can suppress the ink supply unit 15 from becoming large in the gravitational direction. In addition, it is possible to effectively utilize the space formed by the sub-tank 151 whose shape is long in the gravitational direction.

The present embodiment takes a configuration such that even in a case where the first functional component group 153 and the second functional component group 155 overlap each other in a plan view (in a case where the first functional component group 153 and the second functional component group 155 overlap as viewed from the z-direction), a gap is formed in the z-direction. However, the sum of the gravitational-directional size of the first functional component group 153 and the gravitational- directional size of the second functional component group 155 may exceed the gravitational-directional size (height H) of the sub-tank 151. In this case, the arrangement of the first functional component group 153 on the ink flow path plate 152 may be shifted, or the arrangement of the second functional component group 155 below the atmosphere communication plate 154 should be shifted.

Further, the foregoing description has described an example in which the first functional component group 153 and the second functional component group 155 which mainly act on the flow paths are disposed within the range of the sub-tank 151 in the z-direction (gravitational direction), but other components may be disposed within the range. For example, the drive mechanism such as a motor or a gear (neither shown) for driving the drive valve or the pump may be disposed within the range of the sub-tank 151 in the z-direction (gravitational direction).

The present disclosure can provide a printing apparatus with improved compactness.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-066377, filed Mar. 30, 2018, which is hereby incorporated by reference wherein in its entirety.

What is claimed is:

1. A printing apparatus comprising:

a print head configured to eject ink;

an ink tank configured to contain the ink;

an ink flow path plate having a supply flow path for guiding ink to be supplied from the ink tank to the print head, and a collection flow path for guiding ink to be collected from the print head to the ink tank and provided below the ink tank in a gravitational direction;

an atmosphere communication plate provided above the ink tank in the gravitational direction and having an atmosphere communication flow path for communicating the ink tank with atmosphere;

a first functional component provided above the ink flow path plate in the gravitational direction to act on at least one of the supply flow path and the collection flow path; and a second functional component provided below the atmosphere communication plate in the gravitational direction to act on the atmosphere communication flow path.

2. The printing apparatus according to claim 1, wherein the first functional component includes at least one of:

a drive valve configured to open and close a flow path by using a drive mechanism;

a differential pressure valve configured to open and close a flow path in a case where predetermined pressure from a first direction is generated;

a first circulation pump disposed in the supply flow path and configured to be driven by a drive mechanism;

a second circulation pump disposed in the collection flow path and configured to be driven by a drive mechanism; and a buffer chamber configured to vary a capacity according to a change in a volume of air in a flow path.

3. The printing apparatus according to claim 2, wherein the second functional component includes a drive valve for opening and closing a flow path by using a drive mechanism.

4. The printing apparatus according to claim 1, wherein the first functional component and the second functional component are provided within a range of a gravitational-directional length of the ink tank.

5. The printing apparatus according to claim 2, wherein the drive mechanism is provided above the ink flow path plate in the gravitational direction and below the atmosphere communication plate in the gravitational direction.

6. The printing apparatus according to claim 3, wherein the drive mechanism is provided above the ink flow path plate in the gravitational direction and below the atmosphere communication plate in the gravitational direction.

7. The printing apparatus according to claim 2, wherein the drive mechanism is provided within a range of a gravitational-directional length of the ink tank.

8. The printing apparatus according to claim 3, wherein the drive mechanism is provided within a range of a gravitational-directional length of the ink tank.

9. The printing apparatus according to claim 1, wherein a connection part between the ink tank and the atmosphere communication flow path is provided on a gravitational-directional top surface of the ink tank.

10. The printing apparatus according to claim 3, wherein a connection part between the ink tank and the atmosphere communication flow path is provided on a gravitational-directional top surface of the ink tank.

11. The printing apparatus according to claim 1, wherein connection parts between the ink tank and the supply flow path and the collection flow path are provided on a gravitational-directional bottom surface of the ink tank.

12. The printing apparatus according to claim 3, wherein connection parts between the ink tank and the supply flow path and the collection flow path are provided on a gravitational-directional bottom surface of the ink tank.

13. The printing apparatus according to claim 1, wherein the first functional component is not provided below the ink flow path plate in the gravitational direction, and the second functional component is not provided above the atmosphere communication plate in the gravitational direction.

14. The printing apparatus according to claim 3, wherein the first functional component is not provided below the ink flow path plate in the gravitational direction, and the second functional component is not provided above the atmosphere communication plate in the gravitational direction.

15. The printing apparatus according to claim 1, wherein the ink tank has a shape whose gravitational-directional length is greater than a horizontal-directional length, and includes a liquid level detection unit configured to detect a height of a liquid level.

16. The printing apparatus according to claim 3, wherein the ink tank has a shape whose gravitational-directional length is greater than a horizontal-directional length, and includes a liquid level detection unit configured to detect a height of a liquid level.

17. The printing apparatus according to claim 15, wherein the liquid level detection unit includes a plurality of electrode pins different in gravitational-directional length.

18. The printing apparatus according to claim 16, wherein the liquid level detection unit includes a plurality of electrode pins different in gravitational-directional length.

* * * * *